US010119700B2

(12) United States Patent
Nyman et al.

(10) Patent No.: US 10,119,700 B2
(45) Date of Patent: Nov. 6, 2018

(54) ARRANGEMENT AND METHOD IN SODA RECOVERY BOILER

(71) Applicant: Valmet Technologies Oy, Espoo (FI)

(72) Inventors: Jussi Nyman, Tampere (FI); Kari Haaga, Tampere (FI); Taisto Rajala, Valkkinen (FI)

(73) Assignee: Valmet Technologies Oy, Espoo (FI)

( * ) Notice: Subject to any disclaimer, the term of this patent is extended or adjusted under 35 U.S.C. 154(b) by 99 days.

(21) Appl. No.: 14/870,628

(22) Filed: Sep. 30, 2015

(65) Prior Publication Data

US 2016/0097528 A1 Apr. 7, 2016

(30) Foreign Application Priority Data

Oct. 3, 2014 (FI) ..... 20145866

(51) Int. Cl.
*F22B 1/20* (2006.01)
*F22B 1/18* (2006.01)
*D21C 11/12* (2006.01)

(52) U.S. Cl.
CPC ..... *F22B 1/1892* (2013.01); *D21C 11/12* (2013.01)

(58) Field of Classification Search
CPC ..... F22B 1/20; F22B 21/343
See application file for complete search history.

(56) References Cited

U.S. PATENT DOCUMENTS 1,776,178 A 9/1930 Carlson
2,268,560 A 1/1942 Bailey
4,442,800 A * 4/1984 Seifert ..... F22B 21/345 122/379
5,787,844 A * 8/1998 Paju ..... F22B 31/045 122/379
5,803,020 A * 9/1998 Palmgren ..... D21C 11/12 110/238
5,950,574 A * 9/1999 Matsuda ..... F22G 7/14 122/460
6,178,924 B1 * 1/2001 Hakulinen ..... D21C 11/12 122/235.33
6,609,482 B2 * 8/2003 Ruohola ..... F22D 1/36 122/479.2
7,434,543 B2 * 10/2008 Raukola ..... D21C 11/12 122/461

(Continued)

FOREIGN PATENT DOCUMENTS

CA 2905628 A1 * 4/2016 ..... F22B 1/1892
EP 1188986 A2 3/2002

(Continued)

OTHER PUBLICATIONS

European Patent Office, Extended European Search Report for Application No. 15187828.7, dated Feb. 24, 2016, 3 pages, Germany.

(Continued)

*Primary Examiner* — Gregory A Wilson
(74) *Attorney, Agent, or Firm* — Alston & Bird LLP

(57) ABSTRACT

An arrangement and a method in a soda recovery boiler. The soda recovery boiler comprises a second pass which is provided with at least one superheater and a second pass ash hopper, a front and/or rear wall of the ash hopper being connected to steam circulation of the soda recovery boiler.

19 Claims, 5 Drawing Sheets

(56) References Cited

U.S. PATENT DOCUMENTS

| | | | | |
|---|---|---|---|---|
| 7,587,994 | B2 * | 9/2009 | Raukola | D21C 11/12 122/470 |
| 2006/0249098 | A1 * | 11/2006 | Raukola | D21C 11/12 122/7 R |
| 2006/0288963 | A1 * | 12/2006 | Raukola | D21C 11/12 122/7 R |
| 2009/0241860 | A1 * | 10/2009 | Monacelli | F22B 33/10 122/7 R |
| 2015/0275427 | A1 * | 10/2015 | Niemi | F22B 21/343 122/460 |

FOREIGN PATENT DOCUMENTS

| | | | |
|---|---|---|---|
| EP | 1726712 | A1 | 11/2006 |
| EP | 1728919 | A1 | 12/2006 |
| EP | 1990574 | A2 | 11/2008 |
| WO | WO 2000/029666 | A1 | 5/2000 |
| WO | WO 2014/044911 | A1 | 3/2014 |

OTHER PUBLICATIONS

National Board of Patents and Registration of Finland, Search Report for Application No. 20145866, dated May 12, 2015, 1 page, Finland.

* cited by examiner

ARRANGEMENT AND METHOD IN SODA RECOVERY BOILER

CROSS-REFERENCE TO RELATED APPLICATIONS

This application claims priority to and the benefit of Finnish Application No. 20145866, filed Oct. 3, 2014, the entire disclosure of which as is hereby incorporated by reference herein.

BACKGROUND

The invention relates to an arrangement in a soda recovery boiler.

The invention further relates to a method in a soda recovery boiler.

In a pulp production process, black liquor is burnt in a soda recovery boiler. The tasks of a soda recovery boiler include recovery of chemicals and recovery of thermal energy generated in the burning process.

The soda recovery boiler comprises a furnace fed with black liquor and air required for combustion. An upper part of the boiler is provided with superheaters, and a flue gas duct after the superheater area. In the flue gas duct reside a boiler bank and economizers. The thermal energy generated in the burning process is used for producing superheated high-pressure steam to be used, inter alia, in the production of electricity.

When the temperature of the superheated steam is to be raised, some of the superheaters may be arranged in a second pass, i.e. in a first duct part of the flue gas duct after the boiler. Consequently, the temperature of the surfaces of the second pass may rise too much.

BRIEF SUMMARY

The arrangement and method in a soda recovery boiler according to the invention are characterized by what is disclosed in the characterizing parts of the independent claims. Other embodiments of the invention are characterized by what is disclosed in the other claims.

Inventive embodiments are also disclosed in the specification and drawings of this application. The inventive contents of the application may also be defined in ways other than those described in the claims below. The inventive contents may also consist of several separate inventions, particularly if the invention is examined in the light of expressed or implicit sub-tasks or in view of obtained benefits or benefit groups. In such a case, some of the definitions contained in the claims below may be unnecessary in view of the separate inventive ideas. Features of the different embodiments of the invention may be applied in connection with other embodiments within the scope of the basic inventive idea.

In the arrangement according to the invention, a front and/or rear wall of a second pass ash hopper of the soda recovery boiler is connected to steam circulation of the soda recovery boiler. The advantage is that the second pass located in a hot area can be cooled efficiently as well as heat from the flue gas can be transferred to the process of superheating steam.

The method according to the invention comprises cooling the second pass by conveying steam to the front and/or rear wall of the second pass ash hopper. The advantage is that the temperature of the second pass can be kept under control in an efficient and simple manner.

In the following, features of some embodiments of the invention are listed in a random order. The characteristics of the process in question determine the most advantageous embodiment to use at any given time.

The idea of an embodiment is that a drum of the soda recovery boiler is connected directly to the front and/or rear wall for feeding steam.

The idea of an embodiment is that the drum of the soda recovery boiler is connected indirectly to the front and/or rear wall for feeding steam.

The idea of an embodiment is that the furnace of the soda recovery boiler, before the superheaters, is provided with a steam screen pipe system connected to the front and/or rear wall of the ash hopper for feeding steam.

The idea of an embodiment is that the furnace of the soda recovery boiler comprises a furnace roof superheater connected to the front and/or rear wall of the ash hopper for feeding steam.

The idea of an embodiment is that the second pass ash hopper comprises an ash hopper roof superheater connected to the front and/or rear wall of the ash hopper for feeding steam.

The idea of an embodiment is that the front and rear wall of the ash hopper are connected to the steam circulation in series so that steam is arranged to be fed from the front wall of the ash hopper to the rear wall thereof, or vice versa.

The idea of an embodiment is that the front and rear wall of the ash hopper are connected to the steam circulation in parallel so that only some of the steam to be conveyed to the front and the rear walls is fed to each of them.

The idea of an embodiment is that the front wall of the ash hopper is connected to the steam circulation and the rear wall is water-cooled.

The idea of an embodiment is that the rear wall of the ash hopper is integrated into a front wall of the boiler bank, which is connected to water circulation.

The idea of an embodiment is that steam is arranged to be fed from the front and/or rear wall of the ash hopper to a second pass side wall.

The idea of an embodiment is that steam is arranged to be fed from the front and/or rear wall of the ash hopper to the second pass side wall and further to a hanging superheater arranged inside the second pass.

BRIEF DESCRIPTION OF THE DRAWINGS

Figure 1:
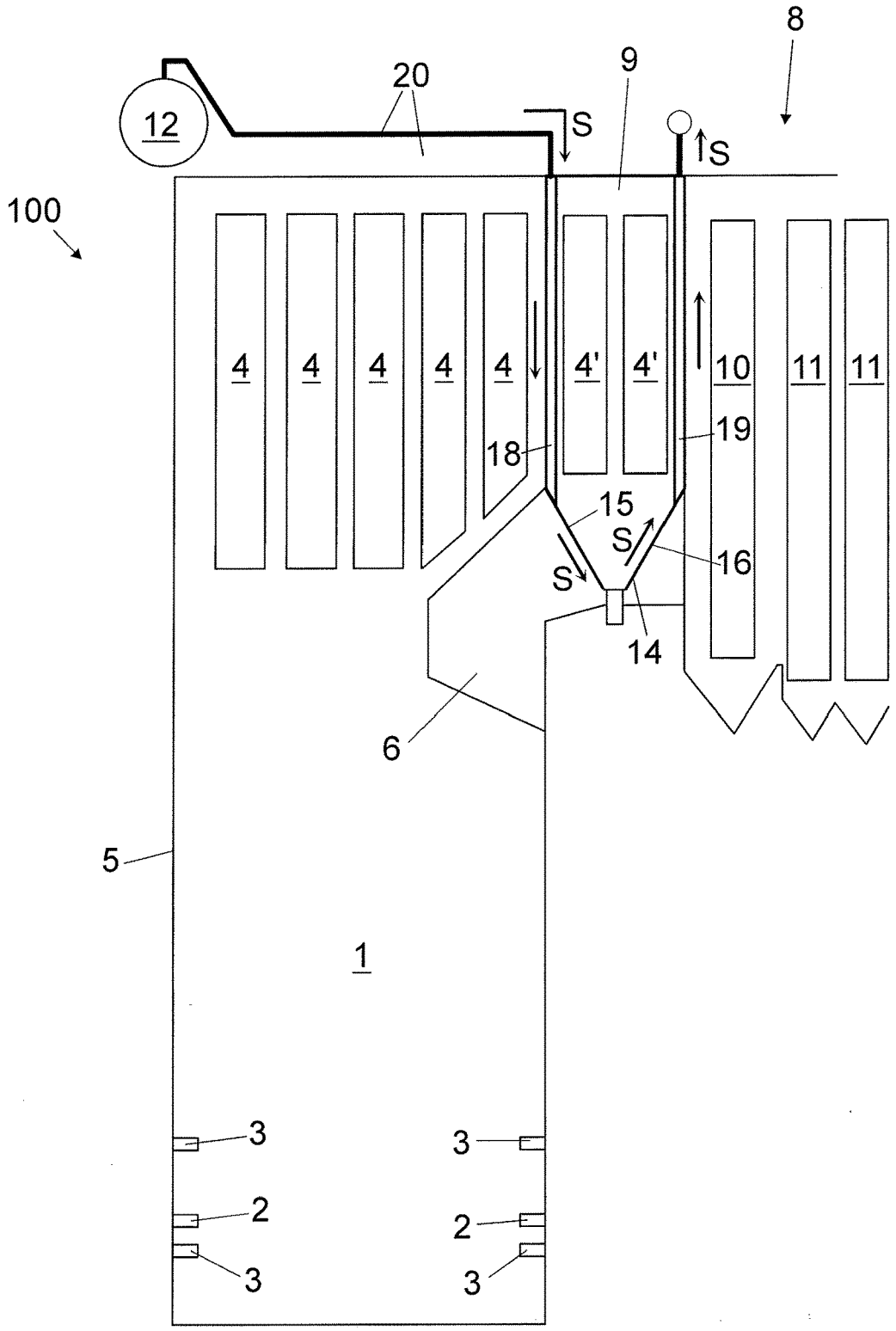
Figure 2:
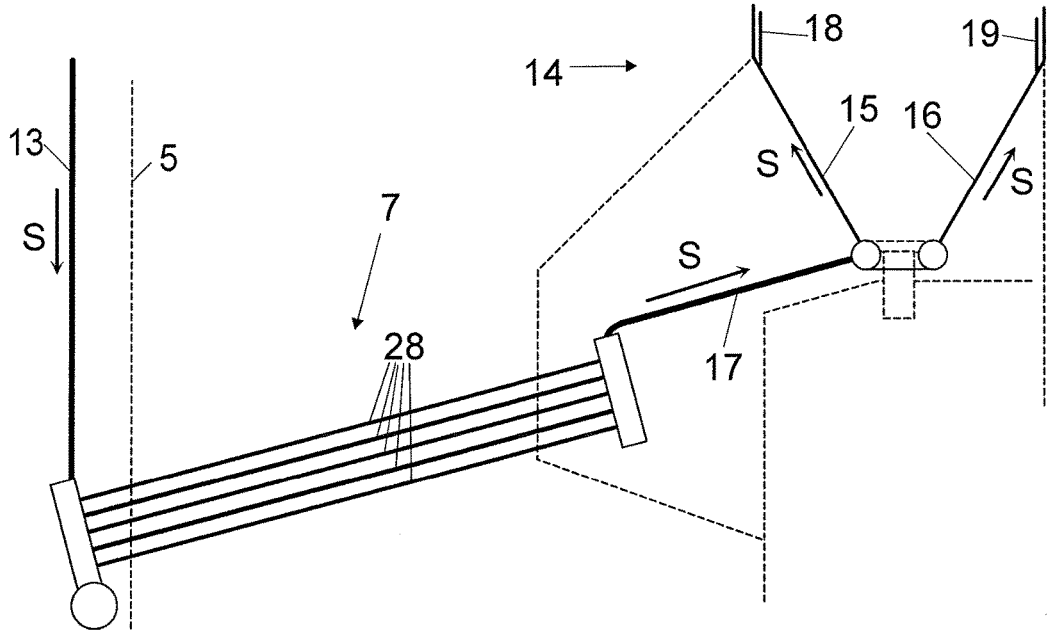
Figure 3A:
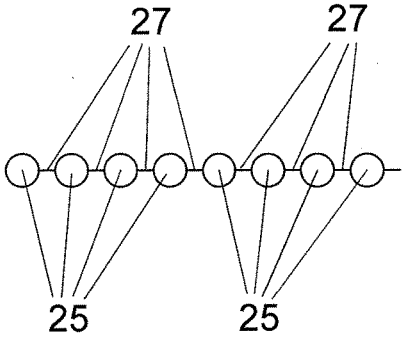
Figure 3B:
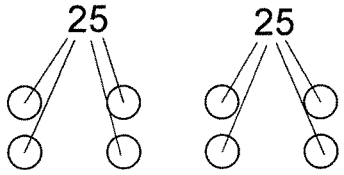
Figure 4:
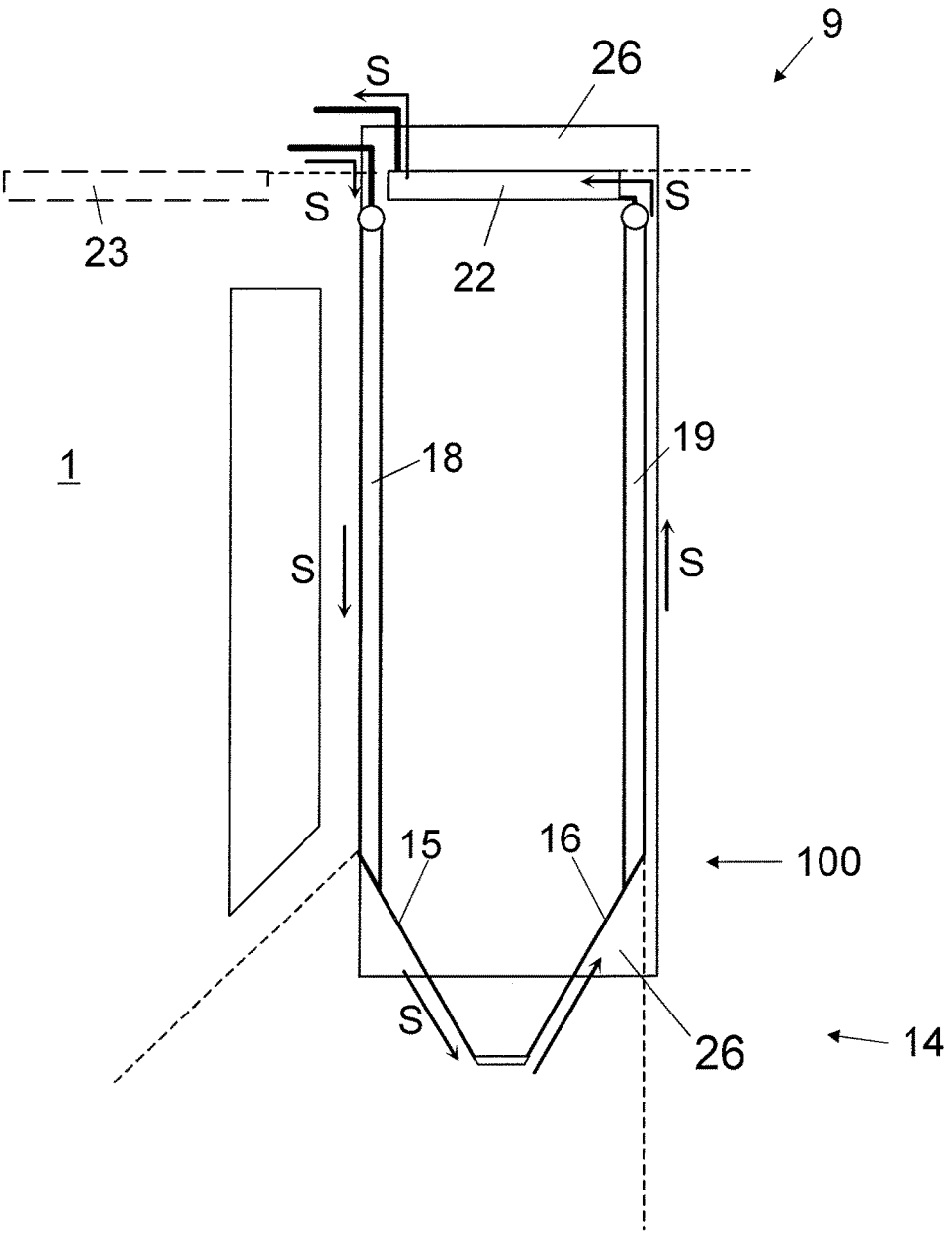
Figure 5:
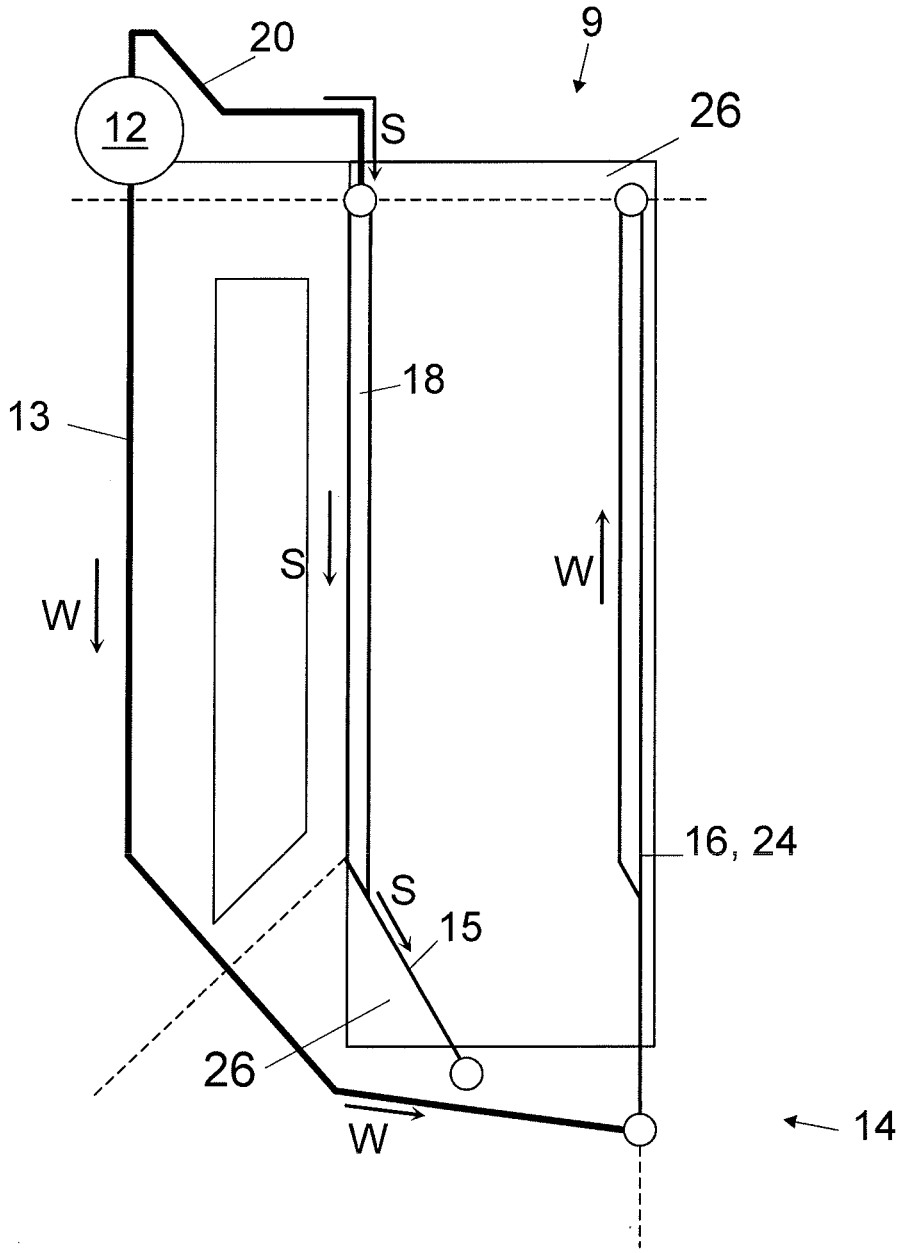
Figure 6:
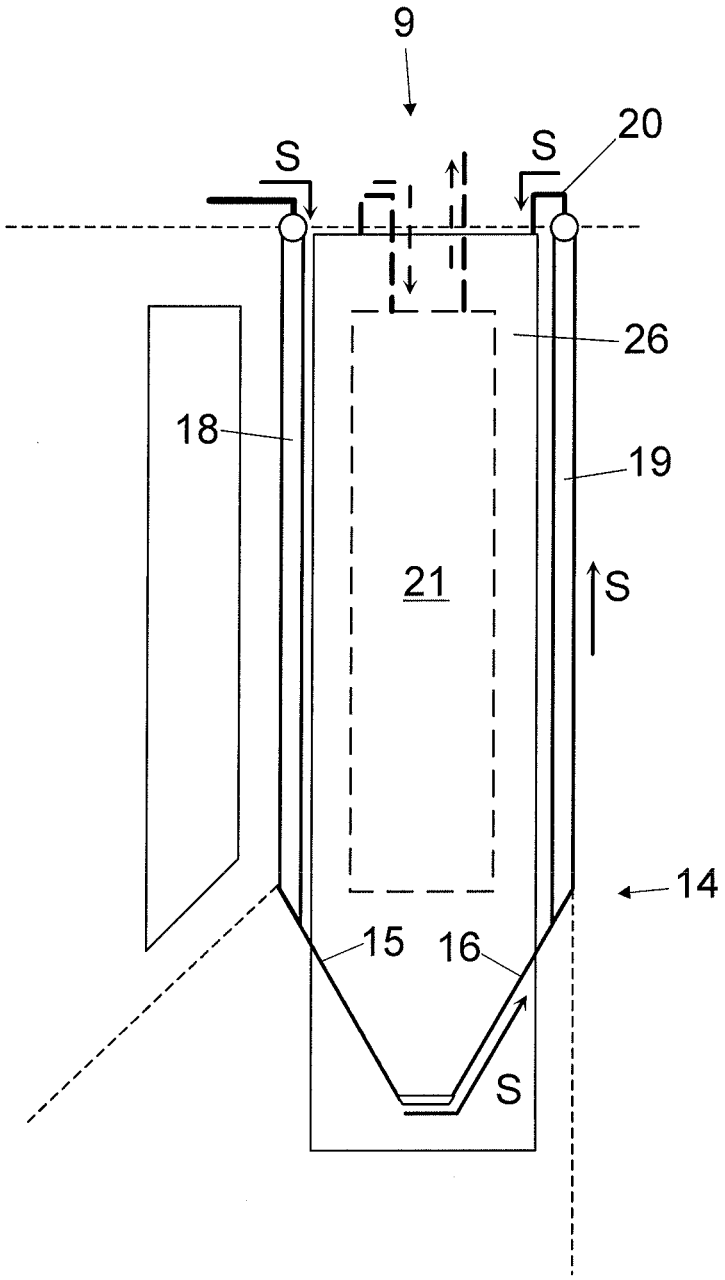

Having thus described the invention in general terms, reference will now be made to the accompanying drawings, which are not necessarily drawn to scale, and wherein:

FIG. 1 is a schematic, partially sectional side view of a soda recovery boiler, FIG. 2 is a schematic, partially sectional side view of a detail of the soda recovery boiler, FIG. 3*a* shows a first cross-section of an ash hopper, FIG. 3*b* shows a second cross-section of an ash hopper, FIG. 4 is a schematic, partially sectional side view of a structure of a second pass of the soda recovery boiler, FIG. 5 is a schematic, partially sectional side view of a second structure of the second pass of the soda recovery boiler, and FIG. 6 is a schematic, partially sectional side view of a third structure of the second pass of the soda recovery boiler.

For the sake of clarity, the figures show the inventive matter in a simplified manner. In the figures, like reference numerals identify like elements.

DETAILED DESCRIPTION OF VARIOUS EMBODIMENTS

Various embodiments of the present invention will now be described more fully hereinafter with reference to the accompanying drawings, in which some, but not all embodiments of the invention are shown. Indeed, embodiments of the invention may be embodied in many different forms and should not be construed as limited to the embodiments set forth herein. Rather, these embodiments are provided so that this disclosure will satisfy applicable legal requirements. Unless otherwise defined, all technical and scientific terms used herein have the same meaning as commonly known and understood by one of ordinary skill in the art to which the invention relates. The term "or" is used herein in both the alternative and conjunctive sense, unless otherwise indicated. Like numbers refer to like elements through-out.

Still further, to facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

FIG. 1 is a schematic, partially sectional side view of a soda recovery boiler. The soda recovery boiler comprises a furnace 1 into which black liquor to be burnt is fed through nozzles 2. Combustion air is fed to the furnace 1 through air nozzles 3.

An upper part of the furnace 1 of the soda recovery boiler is provided with superheaters 4. The superheaters 4 are elements formed by a plurality of parallelly located vertical pipes and provided parallelly in a plural number in a transverse direction of the soda recovery boiler. The superheaters contain steam flowing therein and heating up when the pipes are heated by hot flue gases from outside.

The soda recovery boiler may comprise a nose 6 to guide a flow of the flue gases.

After the upper part of the furnace 1 and the second pass 9, the flue gases flow to convection temperature surfaces 8 which comprise successive duct parts interconnected at their ends.

The second pass 9 is provided with superheaters 4'. These superheaters 4' enable the temperature of superheated steam to be raised, as compared with a solution wherein only the upper part of the soda recovery boiler is provided with superheaters.

Walls 5 of the soda recovery boiler and the superheaters 4, 4' are so-called temperature surfaces. These temperature surfaces are either provided with pipes spaced apart from one another or they are made into gas-tight walls by welding, like the boiler walls 5.

The second pass 9 comprises an ash hopper 14 for the purpose of recovering chemicals and ash and for enabling them to be removed from the second pass 9.

The ash hopper 14 comprises a cooled front wall 15 and a cooled rear wall 16, which enable the temperature of the surfaces of the ash hopper 14 to be lowered. The structure and operation of the cooled front and rear walls 15, 16 will be discussed more specifically below. The cooled front and rear walls make it possible to lower the temperature of the surfaces of the ash hopper enough for their risk of damage to be reduced.

Typically, the convection temperature surfaces 8 after the second pass 9 are provided with more temperature surfaces, for instance boiler banks 10 and economizers 11 known per se.

The soda recovery boiler further comprises a water and steam system. This includes a drum 12 wherefrom warm water and steam are conveyed to the temperature surfaces of the soda recovery boiler. In the embodiment shown in FIG. 1, the drum 12 is connected directly to the front and rear walls 15, 16 for feeding steam in a manner to be disclosed next.

Cooling pipes of the front and rear walls 15, 16 of the ash hopper 14 form a closed structure in a lower part of the hopper, an example thereof being shown in FIG. 3*a*. Further up, said cooling pipes are grouped into a front wall grid tube system 18 and into a rear wall grid tube system 19. The grid tube system 18, 19 comprises tubes that are spaced apart from one another and arranged at least substantially upright, allowing flue gases to flow on therethrough. An example of the cross-section of the grid tube system is shown in FIG. 3*b*.

The front wall grid tube system 18 is connected to the drum 12. Steam is led from the drum 12 to the cooling pipes of the front wall 15, wherefrom it is led further via the cooling pipes of the rear wall 16 to the rear wall grid tube system 19 and therefrom to the next superheating phase. In other words, the cooling pipes of the front and rear walls 15, 16 are connected in series to the steam circulation of the soda recovery boiler 100.

In another embodiment, the cooling pipes of the front and rear walls 15, 16 of the ash hopper are connected to the steam circulation so that steam is fed first to the cooling pipes of the rear wall 16 and therefrom further to the cooling pipes of the front wall 15, i.e. contrary to that in FIG. 1.

According to an idea, the cooling pipes of the front and rear walls 15, 16 may be divided into parallel circulations so that steam is fed to one of these circulations, after which the steam passes through parallel circulations before being conveyed to the next superheating phase.

The cooling of the front and rear walls enables the temperature of the ash hopper 14 to be kept low enough for e.g. thermal expansion not to cause problems. In addition, heat energy can be transferred to the steam, i.e. the energy content of the steam can be increased, which, inter alia, helps in achieving a higher final temperature for the steam. It is now possible to readily provide steam having a final temperature of 515° C., for instance.

It is to be further noted that in order to simplify the presentation of the matter, the accompanying figures do not show all pipes and chambers of the water and steam system that are interconnected with the temperature surfaces. In practice, however, several downcomers may lead to each temperature surface and several circulation pipes may lead from a temperature surface to the drum. It is still further to be noted that the concept "steam" may refer to both saturated and superheated steam.

FIG. 2 is a schematic, partially sectional side view of a detail of the soda recovery boiler.

A system and a method are shown wherein the drum 12 of the soda recovery boiler is connected indirectly to the front and/or rear wall 15, 16 of the ash hopper for feeding steam. In the disclosed embodiment, the furnace 1 of the soda recovery boiler, before the superheaters and at the nose 6, is provided with a steam screen pipe system 7 connected to the front and/or rear wall 15, 16 of the ash hopper. Steam is fed to the steam screen pipe system 7 from the drum 12 via a steam pipe 13. It is to be noted that in order to simplify the presentation of the matter, no drum 12 is shown.

The steam screen pipe system 7 comprises temperature surface pipes 28. In the temperature surface pipes 28, steam flows and heats up due to the influence of flue gases passing by. Correspondingly, this causes the temperature of the flue gases to drop before they reach the superheaters 4. In addition, the steam screen pipe system 7 protects the superheaters 4 from direct radiation of the furnace.

The steam screen pipe system 7 is connected by one or more connecting pipes 17 to the cooling pipes of the front and rear walls 15, 16 of the second pass ash hopper 14. In other words, the cooling pipes of the second pass ash hopper 14 are connected to receive steam from the steam screen pipe system 7. After the cooling pipes of the front and rear walls 15, 16, the steam may be conveyed to a temperature surface, for instance.

FIG. 3*a* shows a first cross-section of an ash hopper, while FIG. 3*b* shows a second cross-section thereof.

In the cross-section shown in FIG. 3*a*, cooling pipes 25 interconnected by fins 27 form gas-tight front and rear walls in the ash hopper 14. Such a structure may be manufactured by welding, for example. Of course, such a gas-tight structure may also be formed in another manner, for instance by directly joining adjacent cooling pipes 25 together. The sides of the ash hopper 14 abut the side walls of the second pass 9.

In the upper part of the ash hopper 14, the cooling pipes 25 are grouped into a grid shape, as a front wall grid tube system 18 and a rear wall grid tube system 19. A cross-section of the grid shape is shown in FIG. 3*b*. Of course, the grid shape may also be of another kind, as long as the cooling pipes 25 are arranged loosely enough for the grid shape to enable flue gases to flow therethrough.

FIG. 4 is a schematic, partially sectional side view of a structure of a second pass of the soda recovery boiler.

The second pass 9 comprises a second pass roof superheater 22 arranged in the steam circulation of the soda recovery boiler 100 by connecting it in series with the cooling pipes of the front and rear walls 15, 16 of the ash hopper 14. The steam is conveyed for instance from the drum 12—not shown in the figure—to the front wall 15 of the ash hopper, and further to the rear wall 16 of the ash hopper and therefrom to said second pass roof superheater 22. The steam may be conveyed from the second pass roof superheater 22 to a temperature surface.

In another embodiment, the steam is conveyed the other way round with respect to the above, i.e. from the rear wall 16 of the ash hopper to the front wall 15 and therefrom further to the second pass roof superheater 22.

According to an idea, the second pass roof superheater 22 is connected only either to the front wall 15 of the ash hopper or to the rear wall 16 of the ash hopper. It is possible for instance to connect the second pass roof superheater 22 to the front wall 15 of the ash hopper whereas the rear wall 16 is cooled by water circulation.

FIG. 4 shows in broken line a furnace roof superheater 23 arranged in the furnace 1 of the soda recovery boiler. This may be connected to the front and/or rear wall 15, 16 of the ash hopper 14, like the second pass roof superheater 22. Of course, the soda recovery boiler 100 may comprise both roof superheaters 22, 23, in which case they both may be connected to the front and/or rear wall 15, 16 of the ash hopper 14.

In addition to the aforementioned connections, second pass side walls 26 or at least one of them may be connected to the front and/or rear wall 15, 16 of the ash hopper and/or the roof superheaters 22, 23.

FIG. 5 is a schematic, partially sectional side view of a second structure of the second pass of the soda recovery boiler. Herein, the front wall 15 of the ash hopper is connected to the steam circulation. The steam is conveyed from the front wall 15 of the ash hopper to a temperature surface, for instance to the second pass side wall 26. The ash hopper 14 has no separate rear wall 16 of its own, but a front wall 24 of the boiler bank serves in place thereof. This can also be expressed such that the rear wall 16 of the ash hopper is integrated into the front wall 24 of the boiler bank. Said commonly shared front wall 16, 24 is connected to the water circulation; in other words, it is water-cooled. The water can be conveyed from the drum 12 along a downcomer 13 to the lower part of the ash hopper 14 and therefrom up the front wall 16, 24 of the boiler bank, where it evaporates.

The integrated wall 16, 24 is connected back to the drum 12 or to a temperature surface.

At least one side wall 26 of the second pass 9 may be in the steam circulation, in other words steam-cooled, and connected to the front wall 15 of the ash hopper.

FIG. 6 is a schematic, partially sectional side view of a third structure of the second pass of the soda recovery boiler.

The steam cooling the second pass 9 is conveyed first to the grid tube system 18 of the front wall of the ash hopper, therefrom down via the front wall 15 to the rear wall 16 and further up the rear wall grid tube system 19.

The rear wall grid tube system 19 is connected by one or more circulation pipes 20 to at least one second pass side wall 26. The steam may travel up and down the second pass side wall 26 so as to enable the flow of steam to be brought into an optimal range with respect to steam speed and/or pressure loss.

From the second pass side wall 26, the steam may be fed to a temperature surface. An embodiment of the last-mentioned alternative is shown in FIG. 6 in broken line. Herein, the steam is fed from the second pass side wall 26 to a hanging superheater 21 arranged inside the second pass 9, and further therefrom to a temperature surface.

In some cases, features disclosed in this application may be used as such, regard-less of other features. On the other hand, when necessary, features disclosed in this application may be combined in order to provide different combinations.

The drawings and the related description are only intended to illustrate the idea of the invention. It will be apparent to a person skilled in the art that the invention is not restricted to the above-described embodiments disclosing the invention through some examples, but various modifications and different applications of the invention are feasible within the inventive idea defined in the accompanying claims. Therefore it is to be understood that the invention is not limited to the specific embodiments disclosed and that modifications and other embodiments are intended to be included within the scope of the appended claims. Still further, although specific terms are employed herein, they are used in a generic and descriptive sense only and not for purposes of limitation.

REFERENCE NUMERALS

1 furnace
2 black liquor nozzle
3 air nozzle
4, 4' temperature surface
5 wall
6 nose
7 steam screen pipe system
8 convection temperature

9 second pass
10 boiler bank
11 economizer
12 drum
13 downcomer or steam pipe
14 second pass ash hopper
15 front wall of ash hopper
16 rear wall of ash hopper
17 connecting pipe
18 front wall grid tube system
19 rear wall grid tube system
20 circulation pipe
21 hanging superheater
22 second pass roof superheater
23 furnace roof superheater
24 second pass rear wall or boiler bank front wall
25 cooling pipe
26 second pass side wall
27 fin
28 temperature surface pipe
100 soda recovery boiler
S steam passage
W water passage That which is claimed:

1. A soda recovery boiler comprising:
a second pass, the second pass being provided with at least one superheater;
a second pass ash hopper, at least one of a front or a rear wall of the ash hopper being connected to steam circulation of the soda recovery boiler; and
a drum connected to at least one of the front or the rear wall of the ash hopper and configured for feeding steam for the steam circulation of the soda recovery boiler.

2. The soda recovery boiler as claimed in claim 1, wherein the drum is directly connected to at least one of the front or the rear wall.

3. The soda recovery boiler as claimed in claim 1, wherein the drum is indirectly connected to at least one of the front or the rear wall.

4. The soda recovery boiler as claimed in claim 3, wherein:
the soda recovery boiler further comprises a furnace before the superheaters; and
the furnace is provided with a steam screen pipe system connected to at least one of the front or the rear wall of the ash hopper, the steam screen pipe system being configured for feeding steam.

5. The soda recovery boiler as claimed in claim 3, wherein:
the soda recovery boiler further comprises a furnace before the superheaters; and
the furnace comprises a furnace roof superheater connected to at least one of the front or the rear wall of the ash hopper, the furnace roof superheater being configured for feeding steam.

6. The soda recovery boiler as claimed in claim 3, wherein the second pass ash hopper comprises an ash hopper roof superheater connected to at least one of the front or the rear wall of the ash hopper, the ash hopper roof superheater being configured for feeding steam.

7. The soda recovery boiler as claimed in claim 1, wherein the front and rear walls of the ash hopper are connected to the steam circulation in series so that steam is fed from the front wall of the ash hopper to the rear wall thereof.

8. The soda recovery boiler as claimed in claim 1, wherein the front and rear walls of the ash hopper are connected to the steam circulation in series so that steam is fed from the rear wall of the ash hopper to the front wall thereof.

9. The soda recovery boiler as claimed in claim 1, wherein the front and rear walls of the ash hopper are connected to the steam circulation in parallel so that only some of the steam to be conveyed to the front and rear walls is fed to each of them.

10. The soda recovery boiler as claimed in claim 1, wherein the front wall of the ash hopper is connected to the steam circulation and the rear wall is water-cooled.

11. The soda recovery boiler as claimed in claim 10, wherein the rear wall of the ash hopper is integrated into a front wall of the boiler bank, which is connected to water circulation.

12. The soda recovery boiler as claimed in claim 11, wherein steam is arranged to be fed from the second pass side wall to a hanging superheater arranged inside the second pass.

13. The soda recovery boiler as claimed in claim 1, wherein steam is arranged to be fed from at least one of the front or the rear wall of the ash hopper to a second pass side wall.

14. A method in a soda recovery boiler, the method comprising the steps of:
providing a soda recovery boiler comprising:
a second pass;
at least one superheater positioned in the second pass;
a second pass ash hopper having a front and a rear wall; and
a drum connected to at least one of the front or the rear wall of the ash hopper and configured for feeding steam; and
cooling the second pass by conveying steam, via the drum, to at least one of the front or the rear wall of the second pass ash hopper.

15. A method as claimed in claim 14, wherein:
the drum is directly connected to at least one of the front or the rear wall; and
the step of conveying steam occurs from the drum directly to at least one of the front or the rear wall of the ash hopper.

16. A method as claimed in claim 14, wherein:
the drum is indirectly connected to at least one of the front or the rear wall; and
the step of conveying steam occurs from the drum, indirectly and via a temperature surface, to at least one of the front or the rear wall of the second pass ash hopper.

17. A method as claimed in claim 14, wherein
the method further comprises the step of feeding the steam from at least one of the front or the rear wall of the ash hopper directly to the drum.

18. A method as claimed in claim 14, further comprising the step of feeding the steam from at least one of the front or the rear wall of the ash hopper to a temperature surface of the soda recovery boiler.

19. A soda recovery boiler comprising:
a second pass, the second pass being provided with at least one superheater;
a second pass ash hopper, at least a front wall of the ash hopper being connected to steam circulation of the soda recovery boiler; and
a drum connected to at least the front wall of the ash hopper and configured for feeding steam for the steam circulation of the soda recovery boiler.

* * * * *